US010550835B2

(12) United States Patent
Oniduka

(10) Patent No.: US 10,550,835 B2
(45) Date of Patent: Feb. 4, 2020

(54) DUPLEX RECIPROCATING PUMP

(71) Applicant: IWAKI CO., LTD., Tokyo (JP)

(72) Inventor: Toshiki Oniduka, Iruma-gun (JP)

(73) Assignee: IWAKI CO., LTD., Tokyo (JP)

( * ) Notice: Subject to any disclaimer, the term of this patent is extended or adjusted under 35 U.S.C. 154(b) by 241 days.

(21) Appl. No.: 15/563,796

(22) PCT Filed: Mar. 31, 2016

(86) PCT No.: PCT/JP2016/060724

§ 371 (c)(1),
(2) Date: Oct. 2, 2017

(87) PCT Pub. No.: WO2016/163306

PCT Pub. Date: Oct. 13, 2016

(65) Prior Publication Data

US 2018/0073496 A1 Mar. 15, 2018

(30) Foreign Application Priority Data

Apr. 7, 2015 (JP) ..... 2015-078218

(51) Int. Cl.
*F04B 43/107* (2006.01)
*F04B 43/113* (2006.01)

(52) U.S. Cl.
CPC ..... *F04B 43/107* (2013.01); *F04B 43/113* (2013.01); *F04B 43/1136* (2013.01)

(58) Field of Classification Search
CPC ..... F04B 9/12; F04B 9/129; F04B 9/135
(Continued)

(56) References Cited

U.S. PATENT DOCUMENTS 5,480,292 A * 1/1996 Chevallier ..... F04B 15/04 417/393
5,558,506 A * 9/1996 Simmons ..... F01B 1/00 137/625.69

(Continued)

FOREIGN PATENT DOCUMENTS

CN 202300954 U 7/2012
CN 202579075 U 12/2012

(Continued)

OTHER PUBLICATIONS

Jul. 5, 2016 Search Report issued in International Patent Application No. PCT/JP2016/060724.

*Primary Examiner* — Patrick Hamo
(74) *Attorney, Agent, or Firm* — Oliff PLC

(57) ABSTRACT

A duplex reciprocating pump includes: a case member forming a pair of spaces; a movable partitioning member that partitions insides of these spaces into a first and second pump chamber and a first and second actuation chamber; a first switch valve mechanism provided with a first valve mechanism that switches supply of an actuation fluid to the first actuation chamber; a second switch valve mechanism provided with a second valve mechanism that switches supply of the actuation fluid to the second actuation chamber; a first switching mechanism that switches supply to the first switch valve mechanism of a control fluid; and a second switching mechanism that switches supply to the second switch valve mechanism of the control fluid, the first and second switching mechanisms switching supply so as to have an overlap period in which compression steps of the first and second pump chambers partially overlap.

6 Claims, 6 Drawing Sheets

(58) Field of Classification Search
USPC ..... 417/318, 393–395
See application file for complete search history.

(56) References Cited

U.S. PATENT DOCUMENTS

| | | | | |
|---|---|---|---|---|
| 5,893,707 | A * | 4/1999 | Simmons | F04B 43/1136 417/393 |
| 6,742,997 | B2 * | 6/2004 | Murata | F04B 43/0736 417/395 |
| 6,874,997 | B2 * | 4/2005 | Watanabe | F04B 9/135 417/393 |
| 7,458,309 | B2 * | 12/2008 | Simmons | F04B 43/067 417/393 |
| 7,497,670 | B2 * | 3/2009 | Murata | F04B 43/0736 417/395 |
| 7,625,190 | B2 * | 12/2009 | Smith | F04B 7/0233 137/596.14 |
| 9,239,047 | B2 * | 1/2016 | Iwabuchi | F04B 43/10 |
| 2010/0178184 | A1 | 7/2010 | Simmons et al. | |

FOREIGN PATENT DOCUMENTS

| | | | |
|---|---|---|---|
| CN | 202900598 | U | 4/2013 |
| CN | 203430719 | U | 2/2014 |
| JP | 2001-140752 | A | 5/2001 |
| JP | 2001-355568 | A | 12/2001 |
| JP | 3574641 | B2 | 10/2004 |
| JP | 2012-514729 | A | 6/2012 |
| JP | 5315550 | B2 | 10/2013 |
| JP | 2015-034482 | A | 2/2015 |
| WO | 2010/081008 | A1 | 7/2010 |
| WO | 2010/143469 | A1 | 12/2010 |

* cited by examiner

DUPLEX RECIPROCATING PUMP

TECHNICAL FIELD

The present invention relates to a duplex reciprocating pump that transfers a transfer fluid by a pair of pump chambers formed by a pair of movable partitioning members such as bellows.

BACKGROUND ART

A duplex reciprocating pump and bellows pump have conventionally been known (see Patent Documents 1 and 2 listed below). These kinds of pumps have a pair of movable partitioning members such as bellows. Moreover, a pair of closed spaces are demarcated into a pump chamber and an actuation chamber by this pair of movable partitioning members.

By alternately introducing an actuation fluid, by means of a switch valve mechanism, into the pair of actuation chambers demarcated in this way, this kind of pump alternately compresses and extends the pump chamber, thereby transferring a transfer fluid. Note that in this kind of pump, generally, a pulsation corresponding to the number of strokes occurs in a discharge flow rate of the transfer fluid.

This pulsation occurs as a result of a pair of suction valves and a pair of discharge valves respectively switching from one pump chamber side to another pump chamber side at an end section of an extension/contraction operation stroke of the bellows, for example. Because such a pulsation causes a variety of difficulties, solutions have been attempted by the duplex reciprocating pumps disclosed in Patent Documents 1 and 2.

PRIOR ART DOCUMENTS

Patent Documents

Patent Document 1: Japanese Patent No. 5315550
Patent Document 2: Japanese Patent No. 3574641

SUMMARY OF THE INVENTION

Problem to be Solved by the Invention

However, in the pumps disclosed in the above-listed Patent Documents 1 and 2, there is further room for improvement in achieving a high pulsation reducing effect at a low cost.

The present invention has an object of providing a duplex reciprocating pump that can achieve reduction of pulsation of a transfer fluid, while achieving an overall lowering of cost by having operation of a switch valve mechanism of an actuation fluid switched by a control fluid.

Means for Solving the Problem

A duplex reciprocating pump according to the present invention includes: a case member forming a first space and a second space along an axial direction inside thereof; a movable partitioning member disposed deformably inside the first space and the second space, the movable partitioning member partitioning the first space into a first pump chamber and a first actuation chamber and partitioning the second space into a second pump chamber and a second actuation chamber; a first switch valve mechanism including a first valve mechanism that switches supply of an actuation fluid to the first actuation chamber; a second switch valve mechanism including a second valve mechanism that switches supply of an actuation fluid to the second actuation chamber; a first switching mechanism that switches supply to the first switch valve mechanism of a control fluid for operating the first valve mechanism; and a second switching mechanism that switches supply to the second switch valve mechanism of a control fluid for operating the second valve mechanism, the duplex reciprocating pump being characterized in that the first and second switching mechanisms switch supply to the first and second switch valve mechanisms of the control fluid so as to have an overlap period in which a compression step of the first pump chamber and a compression step of the second pump chamber partially overlap.

In one suitable embodiment of the present invention, the first and second switch valve mechanisms each include a valve mechanism main body in which a distribution chamber of the actuation fluid is formed inside thereof and in which the first or second valve mechanism is disposed reciprocatingly inside the distribution chamber.

In one embodiment of the present invention, the valve mechanism main body includes an actuation fluid introduction port through which the actuation fluid supplied from the actuation fluid source is introduced into the distribution chamber, and an actuation fluid inlet/outlet port through which the actuation fluid that has been introduced into the distribution chamber is discharged to the first or second actuation chamber.

In one embodiment of the present invention, the valve mechanism main body further includes a first control fluid inlet/outlet port and a second control fluid inlet/outlet port for introducing the control fluid into the valve mechanism main body.

In one embodiment of the present invention, the first and second valve mechanisms each include a plurality of large-diameter sections formed with a predetermined interval therebetween in an axial direction and a small-diameter section formed between these large-diameter sections, and the actuation fluid is discharged toward the first or second actuation chamber by the first or second valve mechanism moving whereby the actuation fluid introduction port and the actuation fluid inlet/outlet port communicate via the small-diameter section.

In one embodiment of the present invention, the first and second switching mechanisms each include: a valve body housing case; a valve body that reciprocates inside the valve body housing case and is disposed such that a tip thereof projects from the valve body housing case to be capable of being abutted on by a cooperating member that cooperates with the movable partitioning member; and an elastic member that biases the valve body toward the cooperating member.

Effect of the Invention

The present invention makes it possible to achieve reduction of pulsation of a transfer fluid, while achieving an overall lowering of cost by having operation of an actuation fluid switched by a control fluid.

EMBODIMENTS OF THE INVENTION

Hereinafter, a duplex reciprocating pump according to an embodiment of the present invention will be described in detail with reference to the accompanying drawings.

Figure 1:
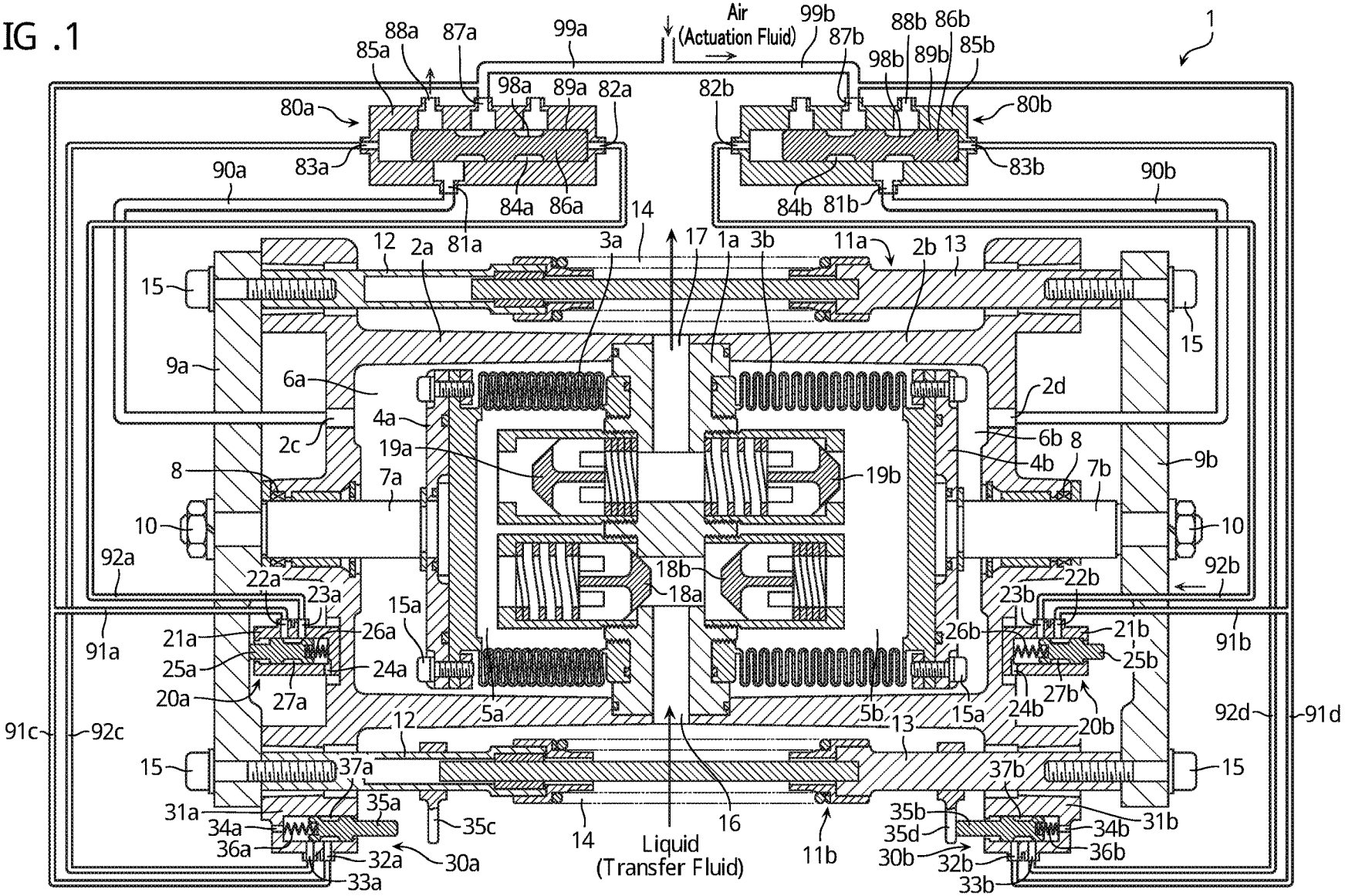
FIG. 1 is a view showing a configuration of a duplex reciprocating pump according to one embodiment of the present invention.

FIG. 1 is a view showing a configuration of a duplex reciprocating pump 1 according to one embodiment of the present invention, and shows a cross section and a peripheral mechanism of the duplex reciprocating pump 1. As shown in FIG. 1, in the duplex reciprocating pump 1, a bottomed cylindrical first cylinder 2*a* and a bottomed cylindrical second cylinder 2*b* which are case members are disposed in a state of being fitted such that their opening sections face each other, on both sides of a pump head 1*a* disposed in a central section.

A pair of spaces are formed along an axial direction on insides of these cylinders 2*a*, 2*b*. A bottomed cylindrical first bellows 3*a* and second bellows 3*b*, made of a fluororesin, for example, that are capable of extension/contraction in the axial direction, are coaxially disposed, in a state of being affixed to the pump head 1*a* such that their respective opening sides face each other, inside these pair of spaces.

These bellows 3*a*, 3*b* have their opening ends fixed in a liquid-tight manner to the pump head 1*a* by being screwed into the pump head 1*a*, for example. Therefore, the bellows 3*a*, 3*b* configure a pair of movable partitioning members that partition internal spaces of the cylinders 2*a*, 2*b* assuming inner sides of the bellows 3*a*, 3*b* to be a first pump chamber 5*a* and second pump chamber 5*b* and outer sides of the bellows 3*a*, 3*b* to be a first actuation chamber 6*a* and second actuation chamber 6*b*.

A shaft fixing plate 4*a* and shaft fixing plate 4*b* are fixed to bottom sections of the bellows 3*a*, 3*b* by bolts 15*a*. One end of a coaxially extending shaft 7*a* and one end of a coaxially extending shaft 7*b* are fixed to the shaft fixing plates 4*a*, 4*b*. The other ends of the shafts 7*a*, 7*b* penetrate, in an air-tight manner, via seal members 8, centers of bottom sections of the cylinders 2*a*, 2*b*, thereby extending to outer sides of the cylinders 2*a*, 2*b*. A coupling plate 9*a* and coupling plate 9*b* are fixed to these other ends of the shafts 7*a*, 7*b* by nuts 10.

The coupling plates 9*a*, 9*b* are coupled in an axial direction by a coupling shaft 11*a* and coupling shaft 11*b* at certain positions on outsides of the cylinders 2*a*, 2*b*, for example, at positions shown upwardly and downwardly in FIG. 1. Each of the coupling shafts 11*a*, 11*b* includes a pair of a shaft section 12 and shaft section 13, and a coil spring 14 which is an extending/contracting member, fitted between these shaft sections 12, 13.

In each of the coupling shafts 11*a*, 11*b*, end sections on opposite sides to coil spring 14 sides of the shaft sections 12, 13 are fixed to the coupling plates 9*a*, 9*b* by bolts 15. As a result, the bellows 3*a*, 3*b* connected via the shafts 7*a*, 7*b* and the shaft fixing plates 4*a*, 4*b* to each of the coupling plates 9*a*, 9*b* are extendably/contractibly coupled, in an axial direction, via the coil spring 14, by each of the coupling shafts 11*a*, 11*b*.

In addition, a suction port 16 and a discharge port 17 of a transfer fluid, for example, a liquid, are provided in the pump head 1*a* at positions facing side surfaces of the pump. A suction valve 18*a* and suction valve 18*b* are provided in pathways reaching from this suction port 16 to the pump chambers 5*a*, 5*b*, and a discharge valve 19*a* and discharge valve 19*b* are provided in pathways reaching from the pump chambers 5*a*, 5*b* to the discharge port 17. These suction valves 18*a*, 18*b* and discharge valves 19*a*, 19*b* configure a valve unit.

A cylinder side inlet/outlet port 2*c* and cylinder side inlet/outlet port 2*d* are provided in bottom sections of the cylinders 2*a*, 2*b*. These cylinder side inlet/outlet ports 2*c*, 2*d* are for an actuation fluid, for example, actuation air supplied from an actuation fluid source such as an unillustrated air compressor, for example, to be introduced into the actuation chambers 6*a*, 6*b* or discharged from the actuation chambers 6*a*, 6*b*, via a first main pipe 90*a* connected to an actuation air inlet/outlet port 81*a* of a first switch valve mechanism 80*a* and a second main pipe 90*b* connected to an actuation air inlet/outlet port 81*b* of a second switch valve mechanism 80*b*.

The first switch valve mechanism 80*a* includes a switch valve 86*a* that switches supply of the actuation air to the actuation chamber 6*a*. The second switch valve mechanism 80*b* includes a switch valve 86*b* that switches supply of the actuation air to the actuation chamber 6*b*. These switch valves 86*a*, 86*b* of the first and second switch valve mechanisms 80*a*, 80*b* are operated by a control fluid, for example, control air whose supply is switched by a first and second switching mechanism 20*a*, 30*a* configuring a first switching mechanism and a third and fourth switching mechanism 20*b*, 30*b* configuring a second switching mechanism that will be mentioned later. The control air is obtained by diverting part of the actuation air from the actuation fluid source.

The first switch valve mechanism 80*a* includes a first valve mechanism main body 85*a* that has a distribution chamber 84*a* of the actuation air formed inside thereof and has the switch valve 86*a* housed reciprocatingly inside thereof. The second switch valve mechanism 80*b* includes a second valve mechanism main body 85*b* that has a distribution chamber 84*b* of the actuation air formed inside thereof and has the switch valve 86*b* housed reciprocatingly inside thereof.

The following are formed in the first and second valve mechanism main bodies 85*a*, namely, an actuation air introduction port 87*a* and actuation air introduction port 87*b* by which the actuation air supplied from the actuation fluid source is introduced into the distribution chambers 84*a*, 84*b*, via an air pipe 99*a* and air pipe 99*b* that have been branched into two branches, and the above-mentioned actuation air inlet/outlet ports 81*a*, 81*b*.

The actuation air inlet/outlet ports 81*a*, 81*b* are for the actuation air that has been introduced into the distribution chambers 84*a*, 84*b* to be discharged to the actuation chambers 6*a*, 6*b* via the first and second main pipes 90*a*, 90*b*, and for the actuation air that has been discharged from the actuation chambers 6*a*, 6*b* to be introduced into the distribution chambers 84*a*, 84*b* via the first and second main pipes 90*a*, 90*b*.

In addition, the following are formed in the first and second valve mechanism main bodies 85*a*, 85*b*, namely an actuation air discharge port 88*a* and actuation air discharge port 88*b* for the actuation air that has been introduced into the distribution chambers 84*a*, 84*b* after being discharged from the actuation chambers 6*a*, 6*b* to be discharged to outside. Note that a later-mentioned first control air inlet/outlet port 82*a* and second control air inlet/outlet port 83*a* are formed in the first valve mechanism main body 85*a*, and a later-mentioned third control air inlet/outlet port 82*b* and fourth control air inlet/outlet port 83*b* are formed in the second valve mechanism main body 85*b*.

The first and second control air inlet/outlet ports 82*a*, 83*a* are for the control air to be introduced into and discharged from inside the first valve mechanism main body 85*a* via first and second control air pipes 92*a*, 92*c*. The third and fourth control air inlet/outlet ports 82*b*, 83*b* are for the control air to be introduced into and discharged from inside the second valve mechanism main body 85*b* via third and fourth control air pipes 92*b*, 92*d*.

The switch valve 86*a* of the first switch valve mechanism 80*a* is reciprocatingly driven by the control air that has been introduced into inside the first valve mechanism main body 85*a* from the first and second control air inlet/outlet ports 82*a*, 83*a*. The switch valve 86*b* of the second switch valve mechanism 80*b* is reciprocatingly driven by the control air that has been introduced into inside the second valve mechanism main body 85*b* from the third and fourth control air inlet/outlet ports 82*b*, 83*b*.

The switch valves 86*a*, 86*b* include three large-diameter sections 89*a*, 89*b* formed with a predetermined interval between them in an axial direction, and two small-diameter sections 98*a*, 98*b* formed between these large-diameter sections 89*a*, 89*b*. The large-diameter sections 89*a*, 89*b* selectively block the actuation air introduction ports 87*a*, 87*b*, the actuation air inlet/outlet ports 81*a*, 81*b*, and the actuation air discharge ports 88*a*, 88*b* formed in the first and second valve mechanism main bodies 85*a*, 85*b*. Moreover, the small-diameter sections 98*a*, 98*b*, along with inner wall surfaces of the first and second valve mechanism main bodies 85*a*, 85*b*, form the distribution chambers 84*a*, 84*b*.

The first switching mechanism 20*a* configuring the first switching mechanism is, for example, detachably fixed to the cylinder 2*a* in part of a bottom section outer wall surface of the cylinder 2*a*. Moreover, the second switching mechanism 30*a* configuring the first switching mechanism is, for example, disposed integrally fixed to the cylinder 2*a* by the likes of integral molding, on a lower side of a bottom section side outer wall surface of the cylinder 2*a*. Such first and second switching mechanisms 20*a*, 30*a* configuring a pair of the first switching mechanisms are provided for switching supply of the control air to the first switch valve mechanism 80*a*.

In addition, the third switching mechanism 20*b* configuring the second switching mechanism is, for example, detachably fixed to the cylinder 2*b* in part of a bottom section outer wall surface of the cylinder 2*b*. Moreover, the fourth switching mechanism 30*b* configuring the second switching mechanism is, for example, disposed integrally fixed to the cylinder 2*b* by the likes of integral molding, on a lower side of a bottom section side outer wall surface of the cylinder 2*b*. Such third and fourth switching mechanisms 20*b*, 30*b* configuring a pair of the second switching mechanisms are provided for switching supply of the control air to the second switch valve mechanism 80*b*.

Note that the first switching mechanism 20*a* and the third switching mechanism 20*b* may, for example, be disposed integrally fixed to the cylinders 2*a*, 2*b* by the likes of integral molding. Moreover, the second switching mechanism 30*a* and the fourth switching mechanism 30*b* may, for example, be disposed detachably fixed to the cylinders 2*a*, 2*b*.

Note that although detailed description will be mentioned later, the first and second switching mechanisms 20*a*, 30*a* and the third and fourth switching mechanisms 20*b*, 30*b* operate so as to switch supply of the control air to the first and second switch valve mechanisms 80*a*, 80*b* so as to have an overlap period OP (see FIG. 2) in which a compression step of the pump chamber 5*a* and a compression step of the pump chamber 5*b* partially overlap.

The first switching mechanism 20*a* configuring part of the first switching mechanism includes a first housing case 21*a* fixed by detachably fixing an unillustrated flange section to the cylinder 2*a* by screws, for example. The third switching mechanism 20*b* configuring part of the second switching mechanism includes a third housing case 21*b* fixed by detachably fixing an unillustrated flange section to the cylinder 2*b* by screws, for example. An introduction port 22*a* and introduction port 22*b* of the control air and a discharge port 23*a* and discharge port 23*b* of the control air are formed on side surfaces of these first and third housing cases 21*a*, 21*b*.

A control air introduction path 91*a* and control air introduction path 91*b* are connected to the introduction ports 22*a*, 22*b* of the first and third housing cases 21*a*, 21*b*, and the first control air pipe 92*a* and third control air pipe 92*b* are connected to the discharge ports 23*a*, 23*b* of the first and third housing cases 21*a*, 21*b*. Note that an escape hole 24*a* and escape hole 24*b* that communicate insides and outsides of the first and third housing cases 21*a*, 21*b* are formed in certain positions of the first and third housing cases 21*a*, 21*b*, for example, in side surfaces in a vicinity of bottom sections of the first and third housing cases 21*a*, 21*b*.

In addition, the first switching mechanism 20*a* includes a first valve body 25*a* configuring a first valve body, that reciprocates inside the first housing case 21*a*. The third switching mechanism 20*b* includes a third valve body 25*b* configuring a second valve body, that reciprocates inside the third housing case 21*b*. A spring 26*a* and spring 26*b* that bias these first valve body 25*a* and third valve body 25*b* toward the coupling plates 9*a*, 9*b* are provided inside the first and third housing cases 21*a*, 21*b*.

The first valve body 25*a* is disposed such that its tip section projects toward the coupling plate 9*a* from the first housing case 21*a* and can be abutted on by an inner side surface of the coupling plate 9*a*. The third valve body 25*b* is disposed such that its tip section projects toward the coupling plate 9*b* from the third housing case 21*b* and can be abutted on by an inner side surface of the coupling plate 9*b*.

The first and third valve bodies 25*a*, 25*b* are configured such that when, for example, the bellows 3*a*, 3*b* undergo displacement from a position when they have reached a vicinity of a contraction limit position to a position when they have reached the contraction limit position, the tip sections of the first and third valve bodies 25*a*, 25*b* abut continuously on the coupling plates 9*a*, 9*b*. Moreover, the first and third valve bodies 25*a*, 25*b* continue to be pressed into the insides of the first and third housing cases 21*a*, 21*b*, against an elastic force of the springs 26*a*, 26*b*.

Therefore, a flow diverting path 27*a* formed between the first housing case 21*a* and the first valve body 25*a* and a flow diverting path 27*b* formed between the third housing case 21*b* and the third valve body 25*b* open when the bellows 3*a*, 3*b* have reached the vicinity of the contraction limit position and communicate the introduction ports 22*a*, 22*b* and the discharge ports 23*a*, 23*b*. When the flow diverting paths 27*a*, 27*b* have opened, the control air supplied to the first and third switching mechanisms 20*a*, 20*b* from the control air introduction paths 91*a*, 91*b* passes along the first control air pipe 92*a* and the third control air pipe 92*b* to be introduced into the first control air inlet/outlet port 82*a* and the third control air inlet/outlet port 82*b* of the first and second switch valve mechanisms 80*a*, 80*b*.

Moreover, when the tip sections of the first and third valve bodies 25*a*, 25*b* are in a separated state from when they have reached positions immediately before separating from the coupling plates 9*a*, 9*b*, the first and third valve bodies 25*a*, 25*b* protrude from the first and third housing cases 21*a*, 21*b* due to the elastic force of the springs 26*a*, 26*b* to close the flow diverting paths 27*a*, 27*b*. As a result, the first and third valve bodies 25*a*, 25*b* communicate the discharge ports 23*a*, 23*b* and the escape holes 24*a*, 24*b* by the insides of the first and third housing cases 21*a*, 21*b*.

When the flow diverting paths 27*a*, 27*b* have closed in this way, the control air that has been discharged via the first and third control air pipes 92*a*, 92*b* from the first and third control air inlet/outlet ports 82*a*, 82*b* is introduced into insides of the first and third housing cases 21*a*, 21*b* via the discharge ports 23*a*, 23*b* to be discharged to outside from the escape holes 24*a*, 24*b*.

Moreover, the second switching mechanism 30*a* configuring part of the first switching mechanism includes a second housing case 31*a* formed integrally with the cylinder 2*a*. The fourth switching mechanism 30*b* configuring part of the second switching mechanism includes a fourth housing case 31*b* formed integrally with the cylinder 2*b*. An introduction port 32*a* and introduction port 32*b* of the control air and a discharge port 33*a* and discharge port 33*b* of the control air are formed on side surfaces of these second and fourth housing cases 31*a*, 31*b*.

A control air introduction path 91*c* and control air introduction path 91*d* are connected to the introduction ports 32*a*, 32*b* of the second and fourth housing cases 31*a*, 31*b*, and the second control air pipe 92*c* and fourth control air pipe 92*d* are connected to the discharge ports 33*a*, 33*b* of the second and fourth housing cases 31*a*, 31*b*. Note that an escape hole 34*a* and escape hole 34*b* that communicate insides and outsides of the second and fourth housing cases 31*a*, 31*b* are formed in certain positions of the second and fourth housing cases 31*a*, 31*b*, for example, in bottom sections of the second and fourth housing cases 31*a*, 31*b*.

In addition, the second switching mechanism 30*a* includes a second valve body 35*a* configuring the first valve body, that reciprocates inside the second housing case 31*a*. The fourth switching mechanism 30*b* includes a fourth valve body 35*b* configuring the second valve body, that reciprocates inside the fourth housing case 31*b*. A spring 36*a* and spring 36*b* that bias these second valve body 35*a* and fourth valve body 35*b* in a direction that they face each other along their axial directions, specifically, toward an abutting plate 35*c* and abutting plate 35*d* provided in the shaft sections 12, 13 of the coupling shaft 11*b*, are provided inside the second and fourth housing cases 31*a*, 31*b*.

The second valve body 35*a* is disposed such that its tip section projects toward the abutting plate 35*c* from the second housing case 31*a* and can be abutted on by the abutting plate 35*c*. The fourth valve body 35*b* is disposed such that its tip section projects toward the abutting plate 35*d* from the fourth housing case 31*b* and can be abutted on by the abutting plate 35*d*.

The second and fourth valve bodies 35*a*, 35*b* are configured such that when, for example, the bellows 3*a*, 3*b* undergo displacement from a position when they have reached a vicinity of an extension limit position to a position when they have reached the extension limit position, the tip sections of the second and fourth valve bodies 35*a*, 35*b* abut continuously on the abutting plates 35*c*, 35*d*. Moreover, the second and fourth valve bodies 35*a*, 35*b* continue to be pressed into the insides of the second and fourth housing cases 31*a*, 31*b* against an elastic force of the springs 36*a*, 36*b*.

Therefore, a flow diverting path 37*a* formed between the second housing case 31*a* and the second valve body 35*a* and a flow diverting path 37*b* formed between the fourth housing case 31*b* and the fourth valve body 35*b* open when the bellows 3*a*, 3*b* have reached the vicinity of the extension limit position and communicate the introduction ports 32*a*, 32*b* and the discharge ports 33*a*, 33*b*. When the flow diverting paths 37*a*, 37*b* have opened, the control air supplied to the second and fourth switching mechanisms 30*a*, 30*b* from the control air introduction paths 91*c*, 91*d* passes along the second control air pipe 92*c* and the fourth control air pipe 92*d* to be introduced into the second control air inlet/outlet port 83*a* and the fourth control air inlet/outlet port 83*b* of the first and second switch valve mechanisms 80*a*, 80*b*.

Moreover, when the tip sections of the second and fourth valve bodies 35*a*, 35*b* are in a separated state from when they have reached positions immediately before separating from the abutting plates 35*c*, 35*d*, the second and fourth valve bodies 35*a*, 35*b* protrude from the second and fourth housing cases 31*a*, 31*b* due to the elastic force of the springs 36*a*, 36*b* to close the flow diverting paths 37*a*, 37*b*. As a result, the second and fourth valve bodies 35*a*, 35*b* communicate the discharge ports 33*a*, 33*b* and the escape holes 34*a*, 34*b* by the insides of the second and fourth housing cases 31*a*, 31*b*.

When the flow diverting paths 37*a*, 37*b* have closed in this way, the control air that has been discharged via the second and fourth control air pipes 92*c*, 92*d* from the second and fourth control air inlet/outlet ports 83*a*, 83*b* is introduced into insides of the second and fourth housing cases 31*a*, 31*b* via the discharge ports 33*a*, 33*b* to be discharged to outside from the escape holes 34*a*, 34*b*.

In the duplex reciprocating pump 1 according to the present embodiment, supply of actuation air to the actuation chamber 6*a* is switched by switch-operating the switch valve 86*a* of the first switch valve mechanism 80*a* by control air from the first and second switching mechanisms 20*a*, 30*a*. Moreover, supply of actuation air to the actuation chamber 6*b* is switched by switch-operating the switch valve 86*b* of the second switch valve mechanism 80*b* by control air from the third and fourth switching mechanisms 20*b*, 30*b*.

That is, the switch valves 86*a*, 86*b* supply the actuation air to the actuation chamber 6*a* and discharge the actuation air from the actuation chamber 6*b* by, for example, communicating the actuation air introduction port 87*a* and the actuation air inlet/outlet port 81*a* of the first valve mechanism main body 85*a* and communicating the actuation air inlet/outlet port 81*b* and the actuation air discharge port 88*b* of the second valve mechanism main body 85*b*, so as to have the above-mentioned overlap period OP.

In addition, the switch valves 86*a*, 86*b* supply the actuation air to the actuation chamber 6*b* and discharge the actuation air from the actuation chamber 6*a* by, for example, communicating the actuation air introduction port 87*b* and the actuation air inlet/outlet port 81*b* of the second valve mechanism main body 85*b* and communicating the actuation air inlet/outlet port 81*a* and the actuation air discharge port 88*a* of the first valve mechanism main body 85*a*, so as to have the above-mentioned overlap period OP. Moreover, providing the overlap period OP makes it possible to configure such that immediately before a final stage of the compression step (discharge step) where discharge pressure drops of one of the pump chambers, of the pump chambers 5*a*, 5*b*, a liquid is discharged also from the other of the pump chambers, of the pump chambers 5*a*, 5*b*, whereby pulsation of the transfer fluid on a discharge side can be suppressed.

Next, operation of the duplex reciprocating pump 1 configured in this way will be described. During operation of the pump, the first and second switching mechanisms 20*a*, 30*a* configuring the pair of first switching mechanisms and the third and fourth switching mechanisms 20*b*, 30*b* configuring the pair of second switching mechanisms drive the bellows 3*a*, 3*b* switching operation of the first and second switch valve mechanisms 80*a*, 80*b* in the following way, for example, so as to have the overlap period OP in which the compression step of one pump chamber 5*a* and the compression step of the other pump chamber 5*b* partially overlap.

Figure 2:
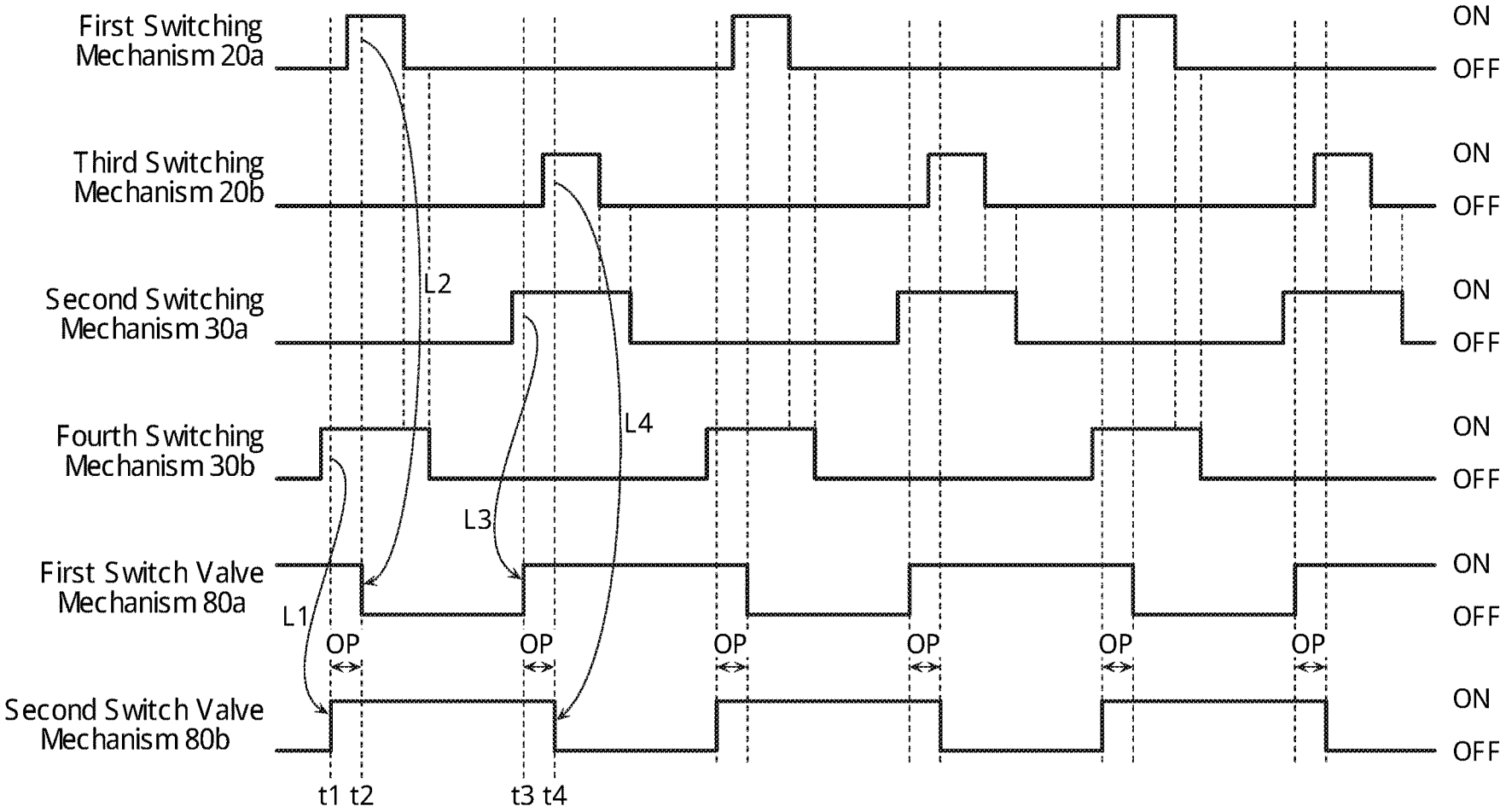
FIG. 2 is a timing chart showing operation of each section of the duplex reciprocating pump.

FIG. 2 is a timing chart for explaining operation of each section of the duplex reciprocating pump 1 according to the present embodiment. In addition, FIGS. 3 to 6 are views for explaining operation of the duplex reciprocating pump 1. Note that in FIG. 2, illustration of a mechanical time lag in operation of each section is omitted. In the present embodiment, actuation air of the actuation fluid source is supplied at all times to the first and second switch valve mechanisms 80*a*, 80*b* via the air pipes 99*a*, 99*b*, after having been adjusted to a certain pressure by an unillustrated regulator, for example. Moreover, the actuation air is supplied at all times to the first through fourth switching mechanisms 20*a*, 30*a*, 20*b*, 30*b* via the control air introduction paths 91*a*-91*d* branched from the air pipes 99*a*, 99*b*.

Note that in the description hereafter, regarding the first and second switch valve mechanisms 80*a*, 80*b*, a time when the switch valves 86*a*, 86*b* are communicating the actuation air introduction ports 87*a*, 87*b* and the actuation air inlet/outlet ports 81*a*, 81*b* is assumed to be an "ON state". Moreover, a time when the switch valves 86*a*, 86*b* are communicating the actuation air inlet/outlet ports 81*a*, 81*b* and the actuation air discharge ports 88*a*, 88*b* is assumed to be an "OFF state".

Moreover, regarding the first through fourth switching mechanisms 20*a*, 30*a*, 20*b*, 30*b*, a time when the first through fourth valve bodies 25*a*, 35*a*, 25*b*, 35*b* are communicating the introduction ports 22*a*, 32*a*, 22*b*, 32*b* and the discharge ports 23*a*, 33*a*, 23*b*, 33*b* via the flow diverting paths 27*a*, 37*a*, 27*b*, 37*b* is assumed to be an "ON state", and a time when these ports are not communicated is assumed to be an "OFF state". Note that configuring elements identical to portions already described will be assigned with reference numerals identical to those assigned to the portions already described, hence, hereafter, duplicated descriptions thereof will be omitted.

First, the overlap period OP when, for example, the switch valves 86*a*, 86*b* of the first and second switch valve mechanisms 80*a*, 80*b* are on a right side in the first and second valve mechanism main bodies 85*a*, 85*b*, and the bellows 3*a* is contracting and the bellows 3*b* is extending, will be described. Since the switch valve 86*a* is on the right side in the first valve mechanism main body 85*a*, the actuation air introduction port 87*a* communicates with the actuation air inlet/outlet port 81*a*, and the actuation air that has been supplied from the actuation fluid source to pass along the air pipe 99*a* passes through the distribution chamber 84*a* of the first switch valve mechanism 80*a* to be introduced into the actuation chamber 6*a* via the first main pipe 90*a*.

As a result, the bellows 3*a* moves in a direction that its bottom section approaches the pump head 1*a* (hereafter, referred to as a "pump head approach direction") thereby contracting, and the shaft sections 12, 12 of the coupling shafts 11*a*, 11*b* similarly move in the pump head approach direction along an axial direction. Moreover, the shaft sections 13, 13 cooperate with the shaft sections 12, 12 of the coupling shafts 11*a*, 11*b* slightly later via the coil spring 14, and the coupling plate 9*b* cooperating with these shaft sections 13, 13 moves in a direction of separating from the pump head 1*a* (hereafter, referred to as a "pump head separation direction").

In a state before time point t1 shown in FIG. 2, the bellows 3*a* continues to contract until it reaches the contraction limit position, and the bellows 3*b* continues to extend until it reaches the extension limit position. Note that since the switch valve 86*b* is on the right side in the second valve mechanism main body 85*b*, the actuation air inlet/outlet port 81*b* and the actuation air discharge port 88*b* communicate, and when the bellows 3*b* is continuing extension, the actuation air in the actuation chamber 6*b* passes through the distribution chamber 84*b* of the second switch valve mechanism 80*b* via the second main pipe 90*b* and is discharged to outside from the actuation air discharge port 88*b*.

In this case, since the suction valve 18*a* and the discharge valve 19*b* are in a closed state and the suction valve 18*b* and the discharge valve 19*a* are in an open state as shown in FIG. 1, the liquid which is the transfer fluid is introduced into the pump chamber 5*b* from the suction port 16 and discharged via the discharge port 17 from the pump chamber 5*a*. Since, in the state before time point t1, the pump chamber 5*a* is during the compression step and the pump chamber 5*b* is during the extension (expansion) step in this way, the first switch valve mechanism 80*a* maintains the ON state and the second switch valve mechanism 80*b* maintains the OFF state as shown in FIGS. 1 and 2.

Then, immediately before time point t1 shown in FIG. 2, when the bellows 3*b* has reached a vicinity of the extension limit position, the abutting plate 35*d* provided in the shaft section 13 of the coupling shaft 11*b* is abutted on by the tip section of the fourth valve body 35*b* of the fourth switching mechanism 30*b* disposed in the cylinder 2*b*. The abutting plate 35*d* continues to press the fourth valve body 35*b* causing it to retreat inside the fourth housing case 31*b*.

As a result, by the introduction port 32*b* and the discharge port 33*b* communicating via the flow diverting path 37*b*, the fourth switching mechanism 30*b* on a cylinder 2*b* side attains the ON state as shown in FIG. 2, while the first switch valve mechanism 80*a* is in the ON state. This ON state of the fourth switching mechanism 30*b* is maintained by the flow diverting path 37*b* opening due to the fourth valve body 35*b* abutting continuously on the abutting plate 35*d*.

When the fourth switching mechanism 30*b* on the cylinder 2*b* side attains the ON state in this way, control air from the control air introduction path 91*d* passes along the fourth control air pipe 92*d* via the flow diverting path 37*b* and is introduced into the fourth control air inlet/outlet port 83*b* of the second switch valve mechanism 80*b*. Due to pressure of this control air, the switch valve 86*b* moves to a left side in the second valve mechanism main body 85*b*. Then, the actuation air introduction port 87*b* and the actuation air inlet/outlet port 81*b* communicate via the small-diameter section 98*b* and the distribution chamber 84*b*, and the second switch valve mechanism 80*b* attains the ON state.

Note that the control air on a third control air inlet/outlet port 82*b* side in the second valve mechanism main body 85*b* is discharged from the third control air inlet/outlet port 82*b* by being pushed out by the switch valve 86*b* that has moved to the left side. Then, the discharged control air passes along the third control air pipe 92*b* to be introduced into the third housing case 21*b* from the discharge port 23*b* of the third switching mechanism 20*b* disposed on the cylinder 2*b* side, and passes through the escape hole 24*b* to be discharged to outside.

Such a structure results in the switch valve 86*b* moving smoothly to the left side along the inside of the second valve mechanism main body 85*b*. In this way, as shown by the arrow curve L1 in FIG. 2, the second switch valve mechanism 80*b* attains the ON state at time point t1 immediately after the fourth switching mechanism 30*b* on the cylinder 2*b* side has attained the ON state. When the second switch valve mechanism 80*b* attains the ON state, the actuation air introduction port 87*b* communicates with the actuation air inlet/outlet port 81*b*, hence actuation air that has been supplied from the actuation fluid source to pass along the air pipe 99*b* passes through the distribution chamber 84*b* of the second switch valve mechanism 80*b* to be introduced into the actuation chamber 6*b* via the second main pipe 90*b*.

As a result, the extension step is switched to the compression step in the pump chamber 5*b*. However, at this time point t1, actuation air is continuing to be supplied via the first switch valve mechanism 80*a* also to the other actuation chamber 6*a*, hence the pump chamber 5*a* also is maintaining the compression step and the overlap period OP in which the compression steps of both of the pump chambers 5*b*, 5*a* overlap is started. In the overlap period OP here, the suction valves 18*a*, 18*b* are in the closed state and the discharge valves 19*a*, 19*b* are in the open state, hence the liquid which is the transfer fluid is discharged from both of the pump chambers 5*a*, 5*b* via the discharge port 17, and pulsation is prevented. Note that the coil spring 14 of the coupling shafts 11*a*, 11*b* is compressed in order to absorb a change in dimensions between both ends of the bellows 3*a*, 3*b* at this time.

When the second switch valve mechanism 80*b* attains the ON state whereby the extension step is switched to the compression step in the pump chamber 5*b*, the bellows 3*b* that has reached the extension limit position contracts so as to move in the pump head approach direction until its bottom section reaches the contraction limit position on an opposite side. Then, the shaft sections 13, 13 of the coupling shafts 11*a*, 11*b* similarly move in the pump head approach direction along an axial direction.

On the other hand, when, on a side of the pump chamber 5*a* that is still during the compression step at a time of time point t1, the bellows 3*a* has got to a final stage of its compression step to reach the vicinity of the contraction limit position in a state after time point t1 and before time point t2, the coupling plate 9*a* is abutted on by the tip section of the first valve body 25*a* of the first switching mechanism 20*a* disposed on a cylinder 2*a* side. The coupling plate 9*a* continues to press the first valve body 25*a* causing it to retreat inside the first housing case 21*a*.

As a result, by the introduction port 22*a* and the discharge port 23*a* communicating via the flow diverting path 27*a*, the first switching mechanism 20*a* on the cylinder 2*a* side attains the ON state like that shown in FIG. 2 immediately before time point t2 and at or after time point t1, while the first and second switch valve mechanisms 80*a*, 80*b* are in the ON state. This ON state of the first switching mechanism 20*a* is maintained by the flow diverting path 27*a* opening due to the first valve body 25*a* abutting continuously on the coupling plate 9*a*.

When the first switching mechanism 20*a* on the cylinder 2*a* side attains the ON state in this way, control air from the control air introduction path 91*a* passes along the first control air pipe 92*a* via the flow diverting path 27*a* and is introduced into the first control air inlet/outlet port 82*a* of the first switch valve mechanism 80*a*. Due to pressure of this control air, the switch valve 86*a* moves to a left side in the first valve mechanism main body 85*a* and the first switch valve mechanism 80*a* attains the OFF state.

Note that the control air on the second control air inlet/outlet port 83*a* side in the first valve mechanism main body 85*a* is discharged from the second control air inlet/outlet port 83*a* by being pushed out by the switch valve 86*a* that has moved to the left side. Then, the discharged control air passes along the second control air pipe 92*c* to be introduced into the second housing case 31*a* from the discharge port 33*a* of the second switching mechanism 30*a* disposed on the cylinder 2*a* side, and passes through the escape hole 34*a* to be discharged to outside.

Such a structure results in the switch valve 86*a* moving smoothly to the left side along the inside of the first valve mechanism main body 85*a*. In this way, as shown by the arrow curve L2 in FIG. 2, the first switch valve mechanism 80*a* attains the OFF state at time point t2 immediately after the first switching mechanism 20*a* on the cylinder 2*a* side has attained the ON state. In this way, the overlap period OP is provided between time point t1 and time point t2.

When the first switch valve mechanism 80*a* attains the OFF state, the actuation air inlet/outlet port 81*a* communicates with the actuation air discharge port 88*a*, hence actuation air in the actuation chamber 6*a* passes through the distribution chamber 84*a* of the first switch valve mechanism 80*a* via the first main pipe 90*a* and is discharged to outside from the actuation air discharge port 88*a*.

The shaft sections 12, 12 move in the pump head separation direction along an axial direction via the coil spring 14, and the coupling plate 9*a* cooperating with the shaft sections 12, 12 moves in the pump head separation direction, slightly later than the shaft sections 13, 13 of the coupling shafts 11*a*, 11*b* that are moving in the pump head approach direction along an axial direction on the side of the bellows 3*b* that is already in the compression step in a state after time point t1.

As a result, at time point t2, the compression step is switched to the extension step in the pump chamber 5*a*. When the pump chamber 5*a* switches to the extension step, the bellows 3*a* that has reached the compression limit position extends so as to move in the pump head separation direction until its bottom section reaches the extension limit position on an opposite side. Then, the shaft sections 12, 12 of the coupling shafts 11*a*, 11*b* similarly move in the pump head separation direction along an axial direction.

Figure 3:
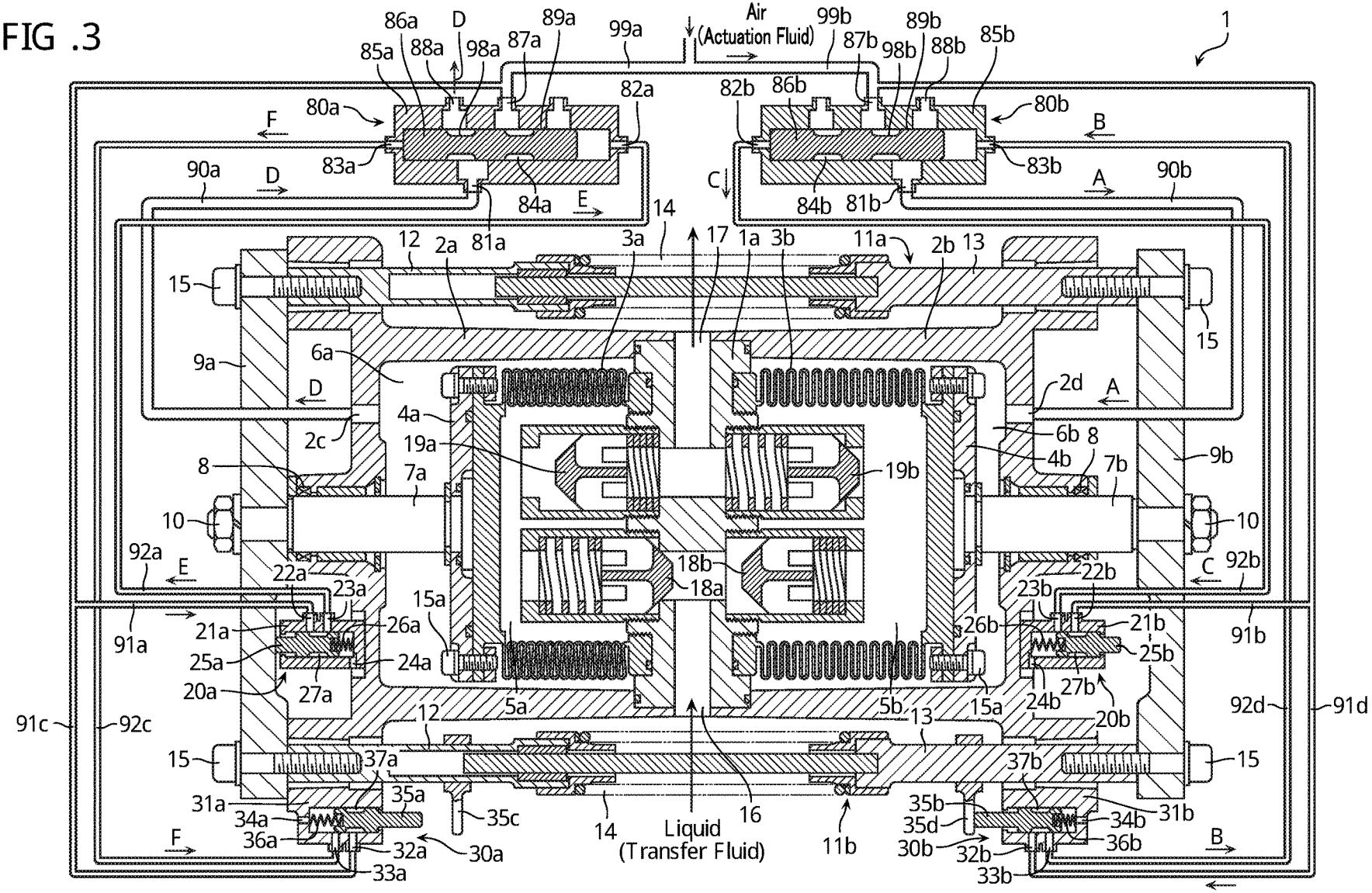
FIG. 3 is a view for explaining operation of the duplex reciprocating pump.

In this way, in a state immediately after time point t2, the duplex reciprocating pump 1 becomes as shown in FIG. 3, for example. That is, the switch valves 86*a*, 86*b* of the first and second switch valve mechanisms 80*a*, 80*b* are moving to the left side in the first and second valve mechanism main bodies 85*a*, 85*b*. Actuation air from the second switch valve mechanism 80*b* is supplied to inside the actuation chamber 6*b* as shown by arrow A in FIG. 3, via the second main pipe 90*b*.

Control air from the control air introduction path 91*d* is introduced into the second valve mechanism main body 85*b* as shown by arrow B in FIG. 3, via the fourth control air pipe 92*d* and the fourth control air inlet/outlet port 83*b*. Control air in the second valve mechanism main body 85*b* is introduced into the third switching mechanism 20*b* and discharged from the escape hole 24*b* as shown by arrow C in FIG. 3, via the third control air inlet/outlet port 82*b* and the third control air pipe 92*b*.

In addition, actuation air in the actuation chamber 6*a* is introduced into the first valve mechanism main body 85*a* as shown by arrow D in FIG. 3, via the first main pipe 90*a* and the actuation air inlet/outlet port 81*a*, and discharged via the distribution chamber 84*a*, the small-diameter section 98*a*, and the actuation air discharge port 88*a*. Control air from the control air introduction path 91*a* is introduced into the first valve mechanism main body 85*a* as shown by arrow E in FIG. 3, via the first control air pipe 92*a* and the first control air inlet/outlet port 82*a*. Control air in the first valve mechanism main body 85*a* is introduced into the second switching mechanism 30*a* and discharged from the escape hole 34*a* as shown by arrow F in FIG. 3, via the second control air inlet/outlet port 83*a* and the second control air pipe 92*c*.

In a state before time point t3 and at or after time point t2 shown in FIG. 2, the bellows 3*a* continues to extend until it reaches the extension limit position, and the bellows 3*b* continues to contract until it reaches the contraction limit position. In this case, since the suction valve 18*b* and the discharge valve 19*a* are in the closed state and the suction valve 18*a* and the discharge valve 19*b* are in the open state, the liquid which is the transfer fluid is introduced into the pump chamber 5*a* from the suction port 16 and discharged via the discharge port 17 from the pump chamber 5*b*. Since, in the state before time point t3 at or after time point t2, the pump chamber 5*a* is during the extension step and the pump chamber 5*b* is during the compression step in this way, the first switch valve mechanism 80*a* maintains the OFF state and the second switch valve mechanism 80*b* maintains the ON state as shown in FIGS. 2 and 3.

Note that after time point t2, when the coupling plate 9*a* separates from the first valve body 25*a* of the first switching mechanism 20*a*, the first switching mechanism 20*a* attains the OFF state like that shown in FIG. 2. When this first switching mechanism 20*a* attains the OFF state, the flow diverting path 27*a* is closed, whereby the discharge port 23*a* and the escape hole 24*a* are communicated.

In addition, after time point t2, when the abutting plate 35*d* separates from the fourth valve body 35*b* of the fourth switching mechanism 30*b* after the first switching mechanism 20*a* has attained the OFF state, the fourth switching mechanism 30*b* attains the OFF state like that shown in FIG. 2. When this fourth switching mechanism 30*b* attains the OFF state, the flow diverting path 37*b* is closed, whereby the discharge port 33*b* is communicated with the escape hole 34*b*.

Then, immediately before time point t3 shown in FIG. 2, when the bellows 3*a* has reached the vicinity of the extension limit position, the abutting plate 35*c* provided in the shaft section 12 of the coupling shaft 11*b* is abutted on by the tip section of the second valve body 35*a* of the second switching mechanism 30*a* disposed on the cylinder 2*a* side. The abutting plate 35*c* continues to press the second valve body 35*a* causing it to retreat inside the second housing case 31*a*.

As a result, by the introduction port 32*a* and the discharge port 33*a* communicating via the flow diverting path 37*a*, the second switching mechanism 30*a* on the cylinder 2*a* side attains the ON state like that shown in FIG. 2 immediately before time point t3 at or after time point t2, while the second switch valve mechanism 80*b* is in the ON state. This ON state of the second switching mechanism 30*a* is maintained by the flow diverting path 37*a* opening due to the second valve body 35*a* abutting continuously on the abutting plate 35*c*.

Figure 4:
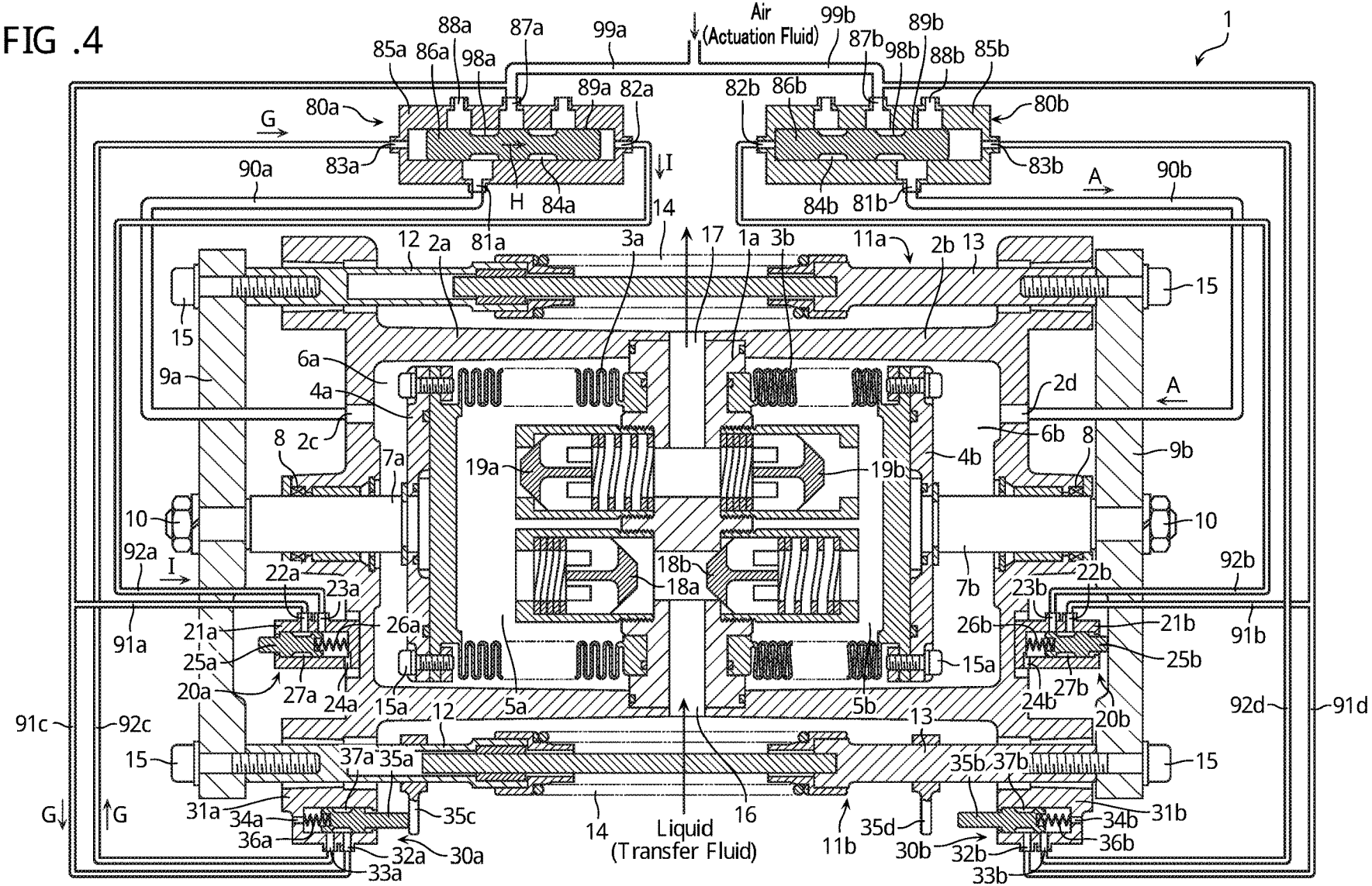
FIG. 4 is a view for explaining operation of the duplex reciprocating pump.

When the second switching mechanism 30*a* on the cylinder 2*a* side attains the ON state in this way, control air from the control air introduction path 91*c* passes along the second control air pipe 92*c* via the flow diverting path 37*a* and is introduced into the second control air inlet/outlet port 83*a* of the first switch valve mechanism 80*a* as shown by arrow G in FIG. 4. Due to pressure of this control air, the switch valve 86*a* moves to the right side in the first valve mechanism main body 85*a* as shown by arrow H in FIG. 4. Then, the actuation air introduction port 87*a* and the actuation air inlet/outlet port 81*a* communicate via the small-diameter section 98*a* and the distribution chamber 84*a*, and the first switch valve mechanism 80*a* attains the ON state.

Note that the control air on a first control air inlet/outlet port 82*a* side in the first valve mechanism main body 85*a* is discharged from the first control air inlet/outlet port 82*a* by being pushed out by the switch valve 86*a* that has moved to the right side. Then, the discharged control air passes along the first control air pipe 92*a* to be introduced into the first housing case 21*a* from the discharge port 23*a* of the first switching mechanism 20*a* on the cylinder 2*a* side, and passes through the escape hole 24*a* to be discharged to outside, as shown by arrow I in FIG. 4.

Such a structure results in the switch valve 86*a* moving smoothly to the right side along the inside of the first valve mechanism main body 85*a*. In this way, as shown by the arrow curve L3 in FIG. 2, the first switch valve mechanism 80*a* attains the ON state at time point t3 immediately after the second switching mechanism 30*a* on the cylinder 2*a* side has attained the ON state. When the first switch valve mechanism 80*a* attains the ON state, the actuation air introduction port 87*a* communicates with the actuation air inlet/outlet port 81*a*, hence actuation air that has been supplied from the actuation fluid source to pass along the air pipe 99*a* again passes through the distribution chamber 84*a* of the first switch valve mechanism 80*a* to be introduced into the actuation chamber 6*a* via the first main pipe 90*a*.

As a result, the extension step is switched to the compression step in the pump chamber 5*a*. However, at this time point t3, actuation air is continuing to be supplied via the second switch valve mechanism 80*b* also to the other actuation chamber 6*b*, hence the pump chamber 5*b* is also maintaining the compression step and the overlap period OP in which the compression steps of both of the pump chambers 5*a*, 5*b* overlap is again started. Even in the overlap period OP here, as mentioned above, the liquid which is the transfer fluid is discharged from both of the pump chambers 5*a*, 5*b*, and pulsation is prevented. The coil spring 14 is compressed in order to absorb a change in dimensions between both ends of the bellows 3*a*, 3*b* at this time also.

When the first switch valve mechanism 80*a* attains the ON state whereby the extension step is switched to the compression step in the pump chamber 5*a*, the bellows 3*a* that has reached the extension limit position contracts so as to move in the pump head approach direction until its bottom section reaches the contraction limit position on an opposite side. Then, the shaft sections 12, 12 of the coupling shafts 11*a*, 11*b* again move in the pump head approach direction along an axial direction.

On the other hand, when, on a side of the pump chamber 5*b* that is still in the middle of the compression step at a time of time point t3, the bellows 3*b* has got to a final stage of its compression step to reach the vicinity of the contraction limit position in a state after time point t3 and before time point t4, the coupling plate 9*b* is abutted on by the tip section of the third valve body 25*b* of the third switching mechanism 20*b* disposed in the cylinder 2*b*. The coupling plate 9*b* continues to press the third valve body 25*b* causing it to retreat inside the third housing case 21*b*.

As a result, by the introduction port 22*b* and the discharge port 23*b* communicating via the flow diverting path 27*b*, the third switching mechanism 20*b* on the cylinder 2*b* side attains the ON state like that shown in FIG. 2 immediately before time point t4 at or after time point t3, while the first and second switch valve mechanisms 80*a*, 80*b* are in the ON state. This ON state of the third switching mechanism 20*b* is maintained by the flow diverting path 27*b* opening due to the third valve body 25*b* abutting continuously on the coupling plate 9*b*.

Figure 5:
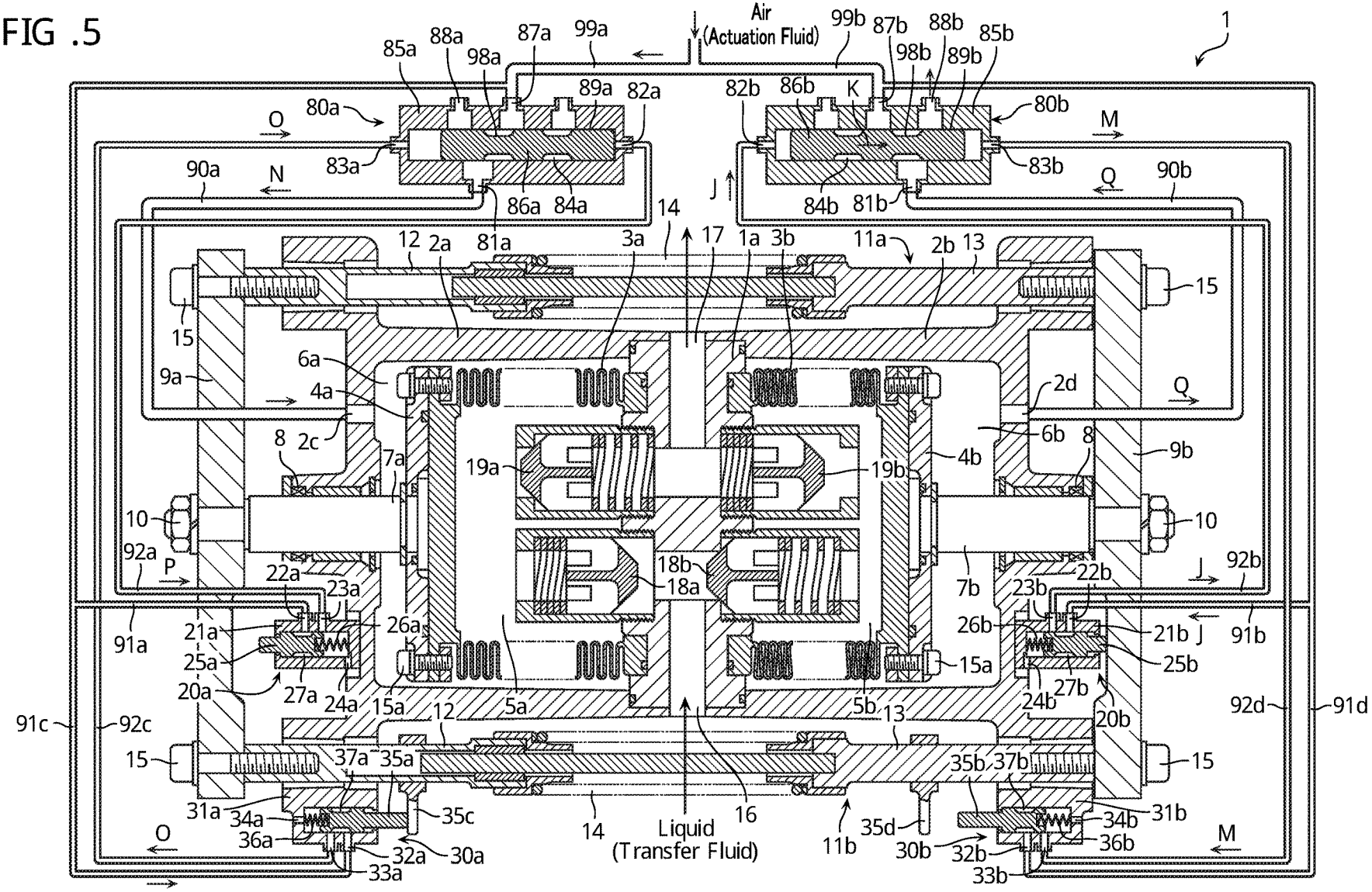
FIG. 5 is a view for explaining operation of the duplex reciprocating pump.

When the third switching mechanism 20*b* on the cylinder 2*b* side attains the ON state in this way, control air from the control air introduction path 91*b* passes along the third control air pipe 92*b* via the flow diverting path 27*b* and is introduced into the third control air inlet/outlet port 82*b* of the second switch valve mechanism 80*b* as shown by arrow J in FIG. 5. Due to pressure of this control air, the switch valve 86*b* moves to a right side in the second valve mechanism main body 85*b* as shown by arrow K in FIG. 5. Then, the actuation air inlet/outlet port 81*b* communicates with the actuation air discharge port 88*b* via the small-diameter section 98*b* and the distribution chamber 84*b*, and the second switch valve mechanism 80*b* attains the OFF state.

Note that the control air on a fourth control air inlet/outlet port 83*b* side in the second valve mechanism main body 85*b* is discharged from the fourth control air inlet/outlet port 83*b* by being pushed out by the switch valve 86*b* that has moved to the right side. This discharged control air passes along the fourth control air pipe 92*d* to be introduced into the fourth housing case 31*b* from the discharge port 33*b* of the fourth switching mechanism 30*b* on the cylinder 2*b* side, and passes through the escape hole 34*b* to be discharged to outside, as shown by arrow M in FIG. 5.

Such a structure results in the switch valve 86*b* moving smoothly to the right side along the inside of the second valve mechanism main body 85*b*. In this way, as shown by the arrow curve L4 in FIG. 2, the second switch valve mechanism 80*b* attains the OFF state at time point t4 immediately after the third switching mechanism 20*b* on the cylinder 2*b* side has attained the ON state. In this way, the overlap period OP is again provided between time point t3 and time point t4.

When the second switch valve mechanism 80*b* attains the OFF state, the actuation air inlet/outlet port 81*b* and the actuation air discharge port 88*b* communicate, hence actuation air in the actuation chamber 6*b* again passes through the distribution chamber 84*b* of the second switch valve mechanism 80*b* via the second main pipe 90*b* and is again discharged to outside from the actuation air discharge port 88*b*.

The shaft sections 13, 13 move in the pump head separation direction along an axial direction via the coil spring 14, and the coupling plate 9*b* cooperating with the shaft sections 13, 13 moves in the pump head separation direction, slightly later than the shaft sections 12, 12 of the coupling shafts 11*a*, 11*b* that are moving in the pump head approach direction along an axial direction on the side of the bellows 3*a* that is already in the compression step in a state after time point t4.

As a result, at time point t4, the compression step is switched to the extension step again in the pump chamber 5*b*. When the compression step is switched to the extension step in the pump chamber 5*b*, the bellows 3*b* that has reached the compression limit position extends so as to move in the pump head separation direction until its bottom section reaches the extension limit position on an opposite side. Then, the shaft sections 13, 13 of the coupling shafts 11*a*, 11*b* again move in the pump head separation direction along an axial direction.

Figure 6:
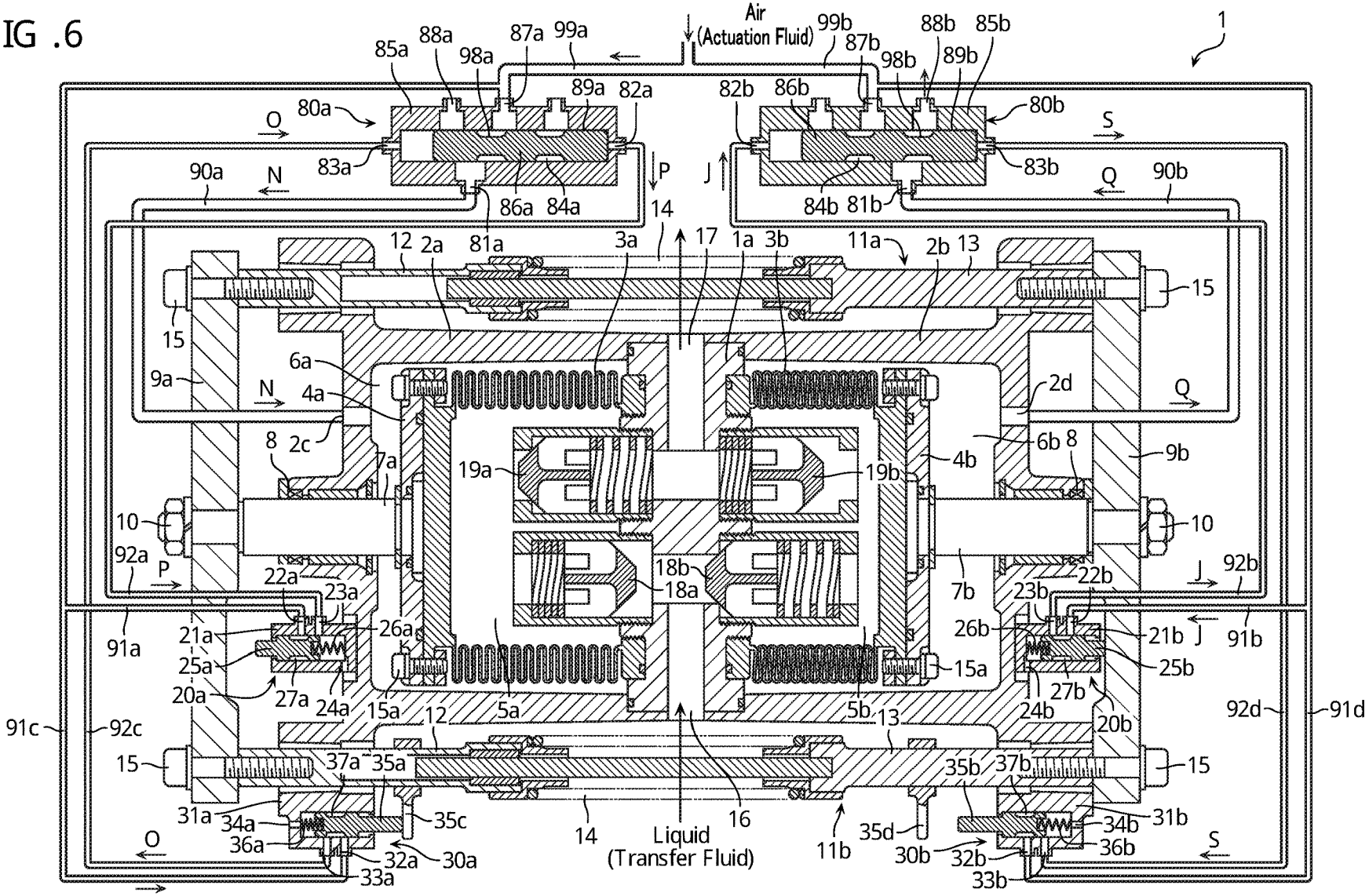
FIG. 6 is a view for explaining operation of the duplex reciprocating pump.

In this way, in a state immediately after time point t4, the duplex reciprocating pump 1 becomes as shown in FIG. 6, for example. That is, the switch valves 86*a*, 86*b* of the first and second switch valve mechanisms 80*a*, 80*b* has moved to the right side in the first and second valve mechanism main bodies 85*a*, 85*b*. Actuation air from the first switch valve mechanism 80*a* is supplied to inside the actuation chamber 6*a* as shown by arrow N in FIG. 6, via the first main pipe 90*a*.

Control air from the control air introduction path 91*c* is introduced into the first valve mechanism main body 85*a* as shown by arrow O in FIG. 6, via the second control air pipe 92*c* and the second control air inlet/outlet port 83*a*. Control air in the first valve mechanism main body 85*a* is introduced into the first switching mechanism 20*a* and discharged from the escape hole 24*a* as shown by arrow P in FIG. 6, via the first control air inlet/outlet port 82*a* and the first control air pipe 92*a*.

In addition, actuation air in the actuation chamber 6*b* is introduced into the second valve mechanism main body 85*b* as shown by arrow Q in FIG. 6, via the second main pipe 90*b* and the actuation air inlet/outlet port 81*b*, and discharged via the distribution chamber 84*b*, the small-diameter section 98*b*, and the actuation air discharge port 88*b*. Control air from the control air introduction path 91*b* is introduced into the second valve mechanism main body 85*b* as shown by arrow J in FIG. 6, via the third control air pipe 92*b* and the third control air inlet/outlet port 82*b*. Control air in the second valve mechanism main body 85*b* is introduced into the fourth switching mechanism 30*b* and discharged from the escape hole 34*b* as shown by arrow S in FIG. 6, via the fourth control air inlet/outlet port 83*b* and the fourth control air pipe 92*d*.

The duplex reciprocating pump 1 according to the present embodiment repeats the above kind of operation from time t4 onwards. That is, the pair of pump chambers 5*a*, 5*b* are driven by switching supply of control air from the first through fourth switching mechanisms 20*a*, 30*a*, 20*b*, 30*b* to operate the first and second switch valve mechanisms 80*a*, 80*b* so as to have the overlap period OP.

In this way, the duplex reciprocating pump 1 according to the present embodiment makes it possible to drive the pump chambers 5*a*, 5*b* so as to have the overlap period OP by combining only mechanical configurations of the first and second switch valve mechanisms 80*a*, 80*b* or first through fourth switching mechanisms 20*a*, 30*a*, 20*b*, 30*b*, without adopting any electrical configuration such as a conventional controller or electromagnetic valve whatsoever.

Therefore, a lowering of cost of the duplex reciprocating pump 1 overall can be achieved while achieving a reduction of pulsation of the transfer fluid. Note that in the above-mentioned embodiment, for example, the first through fourth switching mechanisms 20*a*, 30*a*, 20*b*, 30*b* were configured by so-called mechanical valves and the first and second switch valve mechanisms 80*a*, 80*b* were configured by so-called spool valves. However, these mechanical configurations according to the present embodiment may take a variety of other forms.

While certain embodiments have been described, these embodiments have been presented by way of example only, and are not intended to limit the scope of the inventions. Indeed, the novel embodiments may be carried out in a variety of other forms: furthermore, various omissions, substitutions and changes may be made without departing from the spirit of the inventions. The accompanying claims and their equivalents are intended to cover such forms or modifications as would fall within the scope and spirit of the inventions.

DESCRIPTION OF REFERENCE NUMERALS

1 duplex reciprocating pump
1*a* pump head
2*a*, 2*b* cylinder
3*a*, 3*b* bellows
4*a*, 4*b* shaft fixing plate
5*a*, 5*b* pump chamber
6*a*, 6*b* actuation chamber
7*a*, 7*b* shaft
9*a*, 9*b* coupling plate
11*a*, 11*b* coupling shaft
12, 13 shaft section
14 coil spring
20*a* first switching mechanism
20*b* third switching mechanism
30*a* second switching mechanism
30*b* fourth switching mechanism
80*a* first switch valve mechanism
80*b* second switch valve mechanism

The invention claimed is:

1. A duplex reciprocating pump, comprising:

a case member forming a first space and a second space along an axial direction inside thereof;

a movable partitioning member disposed deformably inside the first space and the second space, the movable partitioning member partitioning the first space into a first pump chamber and a first actuation chamber and partitioning the second space into a second pump chamber and a second actuation chamber;

a first switch valve mechanism comprising a first valve mechanism that switches supply of an actuation fluid to the first actuation chamber;

a second switch valve mechanism comprising a second valve mechanism that switches supply of an actuation fluid to the second actuation chamber;

a first switching mechanism that switches supply to the first switch valve mechanism of a control fluid for operating the first valve mechanism; and a second switching mechanism that switches supply to the second switch valve mechanism of a control fluid for operating the second valve mechanism, wherein the first and second switching mechanisms switch supply to the first and second switch valve mechanisms of the control fluid so as to have an overlap period in which a compression step of the first pump chamber and a compression step of the second pump chamber partially overlap.

2. The duplex reciprocating pump according to claim 1, wherein the first and second switch valve mechanisms each comprise a valve mechanism main body in which a distribution chamber of the actuation fluid is formed inside thereof and in which the first or second valve mechanism is disposed reciprocatingly inside the distribution chamber.

3. The duplex reciprocating pump according to claim 2, wherein each valve mechanism main body comprises:

an actuation fluid introduction port through which the actuation fluid supplied from the actuation fluid source is introduced into the distribution chamber; and an actuation fluid inlet/outlet port through which the actuation fluid that has been introduced into the distribution chamber is discharged to the first or second actuation chamber.

4. The duplex reciprocating pump according to claim 3, wherein each valve mechanism main body further comprises a first control fluid inlet/outlet port and a second control fluid inlet/outlet port for introducing the control fluid into the valve mechanism main body.

5. The duplex reciprocating pump according to claim 3, wherein the first and second valve mechanisms each comprise a plurality of large-diameter sections formed with a predetermined interval therebetween in an axial direction and a small-diameter section formed between these large-diameter sections, and the actuation fluid is discharged toward the first or second actuation chamber by the first or second valve mechanism moving whereby the actuation fluid introduction port and the actuation fluid inlet/outlet port communicate via the small-diameter section.

6. The duplex reciprocating pump according to claim 1, wherein the first and second switching mechanisms each comprise:

a valve body housing case;

a valve body that reciprocates inside the valve body housing case and is disposed such that a tip thereof projects from the valve body housing case to be capable of being abutted on by a cooperating member that cooperates with the movable partitioning member; and an elastic member that biases the valve body toward the cooperating member.

* * * * *